US009548029B2

(12) United States Patent
Kang

(10) Patent No.: US 9,548,029 B2
(45) Date of Patent: Jan. 17, 2017

(54) DISPLAY APPARATUS, LIGHT SOURCE DRIVING APPARATUS AND DRIVING METHOD THEREOF

(71) Applicant: Samsung Electronics Co., Ltd., Suwon-si (KR)

(72) Inventor: Jeong-il Kang, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 290 days.

(21) Appl. No.: 14/269,329

(22) Filed: May 5, 2014

(65) Prior Publication Data

US 2015/0062188 A1 Mar. 5, 2015

(30) Foreign Application Priority Data

Sep. 3, 2013 (KR) ..... 10-2013-0105357

(51) Int. Cl.
*G09G 3/34* (2006.01)

(52) U.S. Cl.
CPC ..... *G09G 3/3406* (2013.01); *G09G 2320/064* (2013.01); *G09G 2320/0626* (2013.01); *G09G 2320/0633* (2013.01); *G09G 2320/0646* (2013.01)

(58) Field of Classification Search
CPC ..... G09G 3/3406; G09G 2320/0626; G09G 2320/0646; G09G 2320/0633
See application file for complete search history.

(56) References Cited

U.S. PATENT DOCUMENTS 7,683,899 B2 * 3/2010 Hirakata ..... G02F 1/133604 345/102
7,746,007 B2 6/2010 Cauffield
8,427,081 B2 4/2013 Hsu et al.
8,830,159 B2 * 9/2014 Liu ..... G09G 3/342 315/169.3
8,914,246 B2 * 12/2014 Chaji ..... G09G 3/3233 702/58
2011/0115889 A1 * 5/2011 Kim ..... G09G 3/003 348/56
2012/0019160 A1 1/2012 Lee et al.
2012/0026170 A1 2/2012 Abe et al.
2014/0320542 A1 * 10/2014 Naruse ..... G06F 3/1454 345/690

FOREIGN PATENT DOCUMENTS

EP 1 950 730 A2 7/2008
EP 2 246 840 A2 11/2010
EP 2 515 291 A1 10/2012
KR 10-2008-0074452 A 8/2008
WO 2013019104 A1 2/2013

OTHER PUBLICATIONS

Communication, Issued by the European Patent Office, Dated Sep. 2, 2014, in counterpart European application No. 14170568.1.

* cited by examiner

*Primary Examiner* — Abbas Abdulselam
(74) *Attorney, Agent, or Firm* — Sughrue Mion, PLLC

(57) ABSTRACT

Disclosed are a display apparatus, a light source driving apparatus and a driving method thereof, the display apparatus including: an image processor which is configured to process an image; and a controller which is configured to set a plurality of current levels corresponding to a plurality of screen modes for a display and control the display to perform a dimming by receiving a current level of a current which corresponds to a screen mode of the display.

28 Claims, 12 Drawing Sheets

DISPLAY APPARATUS, LIGHT SOURCE DRIVING APPARATUS AND DRIVING METHOD THEREOF

CROSS-REFERENCE TO RELATED APPLICATION

This application claims priority from Korean Patent Application No. 10-2013-0105357, filed on Sep. 3, 2013 in the Korean Intellectual Property Office, the entire disclosure of which is hereby incorporated by reference.

BACKGROUND

Field

Apparatuses and methods consistent with the exemplary embodiments relate to a display apparatus, a light source driving apparatus and a driving method thereof. In particular, exemplary embodiments relate to a display apparatus, a light source driving apparatus, and a driving method thereof, in which a driving current for a display is controlled.

Description of the Related Art

A display apparatus performs so-called dimming to a contrast ratio of an image, in which a pulse width modulation (PWM) dimming method of adjusting duty of a current supplied to a light source, an analog dimming method of adjusting a peak value of a current, etc., may be used.

FIG. 1 shows operations of a related art PWM dimming method. FIG. 2 shows electrical and optical characteristics of the related art PWM dimming method.

In the related art PWM dimming as shown in FIG. 1, duty is changed while a current flowing in a light emitting diode (LED) and backlight, i.e., a light source 13, alternates between on and off in a certain cycle. Thus, an average value is adjusted within a PWM cycle, thereby controlling brightness of the backlight. The PWM dimming is quick to respond to a backlight current to a dimming signal, which makes minute dimming possible, and changes the backlight per frame in accordance with brightness of an image displayed on a panel. Also, as shown in FIG. 2, the brightness or power consumption is linearly proportional to the PWM dimming duty, so that circuit and optical characteristics can be easily anticipated. Accordingly, the PWM dimming method has been widely used as a typical dimming method for a light emitting diode (LED) television (TV) and the display apparatus.

In another dimming method of the related art, an analog dimming changes a level of a current to control the brightness of the backlight.

FIG. 3 shows electrical and optical characteristics of a related art analog dimming method.

As shown in FIG. 3, the related art analog dimming shows a saturation inclination in which as a current increases, a light-emission efficiency of a backlight becomes lower while a gradient of increased brightness gradually decreases. Further, as a current increases, a gradient of power consumption gradually increases while voltage applied to the backlight increases. When combining these two characteristics of the analog dimming, the power consumption rapidly increases as the brightness increases. Further, by lowering the current level, the power consumption further decreases as compared with the decrease in the brightness.

In comparison between FIG. 2 and FIG. 3, under the condition that there is a same maximum brightness, it will be understood that the power consumption decreases more in the related art analog dimming method than in the related art PWM dimming method as the brightness becomes lower.

Therefore, as the brightness of the backlight is lowered, the related art analog dimming has an advantage that an optical efficiency of a light source increases and power consumption rapidly decreases. However, relationships between a current and brightness, between a current and power consumption and between brightness and power consumption are not linear, and the response of the backlight current to the analog dimming is slow. Therefore, in accordance with the brightness of the image, the related art analog dimming has a disadvantage that the brightness of the backlight cannot be changed per frame. Also, an analog signal for informing a current level supplied to the backlight has to be input to a driver in order to perform the analog dimming. Therefore, the display apparatus additionally needs a digital/analog (D/A) converter or a similar circuit. Therefore, even though the related art analog dimming has excellent efficiency and heat generation in comparison to the related art PWM dimming method, the related art analog dimming has not been used much in a present LED TV or a display apparatus.

SUMMARY

According to an aspect of an exemplary embodiment, a display apparatus may be provided including: an image processor which is configured to process an image; and a controller which is configured to set a plurality of current levels corresponding to a plurality of screen modes for a display and control the display to perform a dimming by receiving a current level of a current which corresponds to a screen mode of the display.

The display may include a panel configured to display an image; a light source configured to provide light to the panel; and a driver configured to drive the light source, wherein the controller may be further configured to control the driver to supply the light source with the current of the current which corresponds to the screen mode of the display.

The display may be configured to perform pulse width modulation (PWM) dimming to change duty.

The duty of the PWM dimming may be changed up to 100%.

A maximum duty of the PWM dimming may be set in accordance with the plurality of screen modes.

The controller may be further configured to output a current selection signal to the driver corresponding to the screen mode of the driver.

The controller may include a multiplexer which is configured to select and output one reference current among a plurality of reference currents in response to the current selection signal.

The multiplexer may further include a current setup circuit which includes at least one switch configured to turn on or off in response to receiving the current selection signal, and output the one reference current among the plurality of reference currents as the switch is turned on or off.

The plurality of screen modes may include at least two screen modes among a standard mode, a dynamic mode, and an eco mode.

According to another aspect of an exemplary embodiment, a method of driving a display apparatus may be provided which displays an image, the method including: setting up a plurality of current levels corresponding to a plurality of screen modes for a display; selecting a current having a current level which corresponds to a screen mode of the display; and performing a dimming to control a quantity of light in the display by receiving the selected current.

The display may include a panel configured to display an image; a light source configured to provide light to the panel; and a driver configured to drive the light source, wherein the selecting the current may include the driver selecting the current to supply the light source with the current having the current level which corresponds to the screen mode of the display.

The performing the dimming may include performing a pulse width modulation (PWM) dimming to change duty.

The duty of the PWM dimming may be changed up to 100%.

A maximum duty of the PWM dimming may be set in accordance with the plurality of screen modes.

The method may further include outputting a current selection signal corresponding to the screen mode of the display.

The method may further include selecting and outputting one reference current among a plurality of reference currents in response to the current selection signal.

The plurality of screen modes may include at least two screen modes among a standard mode, a dynamic mode, and an eco mode.

According to another aspect of an exemplary embodiment a light source driving apparatus may be provided for a display apparatus, including: a multiplexer which is configured to select one reference current among a plurality of reference currents in response to a current selection signal corresponding to one screen mode of the display apparatus, among a plurality of screen modes; and a constant current controller which is configured to supply the one reference current, which is output from the multiplexer, to a light source of the display apparatus.

The light source driving apparatus may perform a pulse width modulation (PWM) dimming to change duty of the one reference current supplied to the light source.

The duty of the PWM dimming may be varied up to 100%.

A maximum duty of the PWM dimming may be set in accordance with the plurality of screen modes.

The multiplexer may include a current setup circuit which includes at least one switch configured to turn on or off in response to receiving the current selection signal, and output one reference current among the plurality of reference currents as the switch is turned on or off.

The plurality of screen modes may include at least two screen modes among a standard mode, a dynamic mode and an eco mode.

The light source includes at least one light emitting diode (LED).

According to yet another aspect of an exemplary embodiment, a method of driving a light source driving apparatus may be provided for a display apparatus, the method including: selecting one reference current among a plurality of reference currents in response to a current selection signal which corresponds to one screen mode of the display apparatus, among a plurality of screen modes; and supplying the one reference current to a light source of the display apparatus.

BRIEF DESCRIPTION OF THE DRAWINGS

The above and/or other aspects will become apparent and more readily appreciated from the following description of exemplary embodiments, taken in conjunction with the accompanying drawings, in which.

DETAILED DESCRIPTION OF EXEMPLARY EMBODIMENTS

Below, exemplary embodiments of an image reproducing apparatus, a server and image reproducing methods thereof will be described in detail with reference to accompanying drawings.

Figure 1:
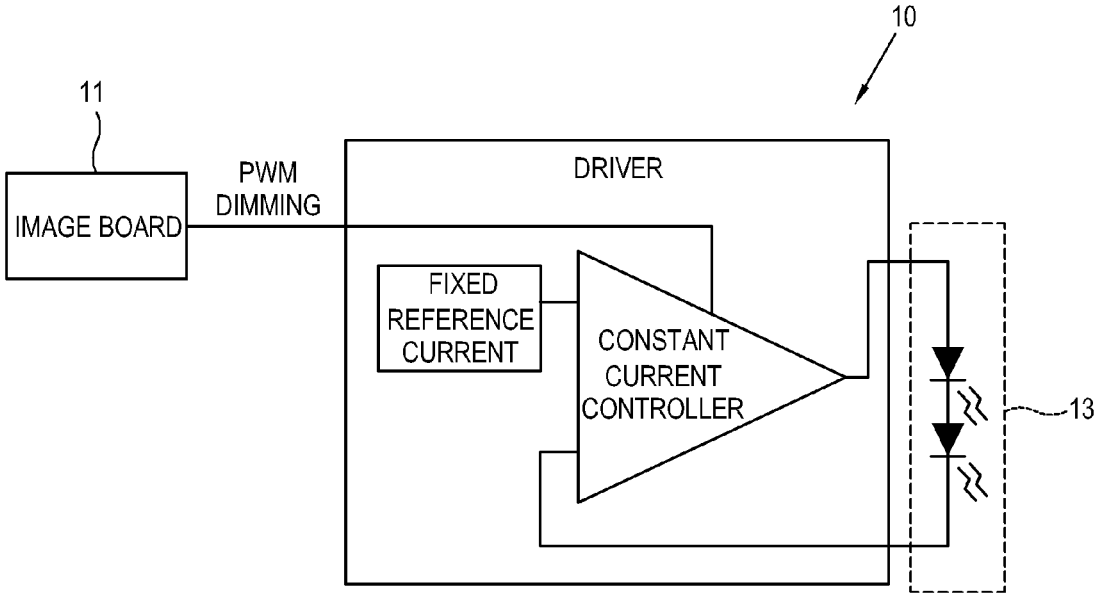
FIG. 1 shows operations of a related art PWM dimming method.
Figure 2:
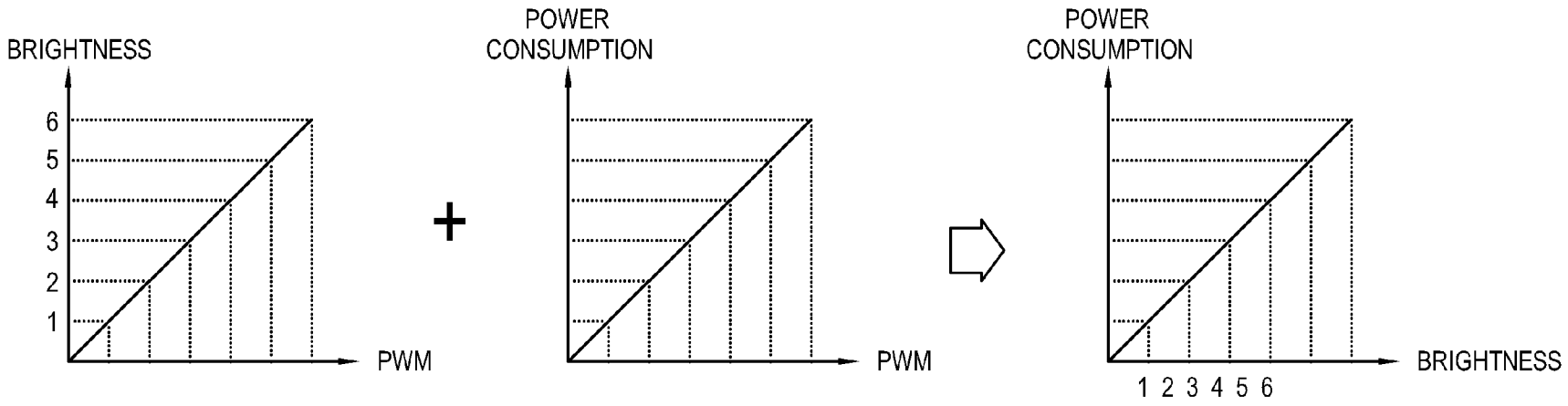
FIG. 2 shows electrical and optical characteristics of the PWM dimming method in FIG. 1.
Figure 3:
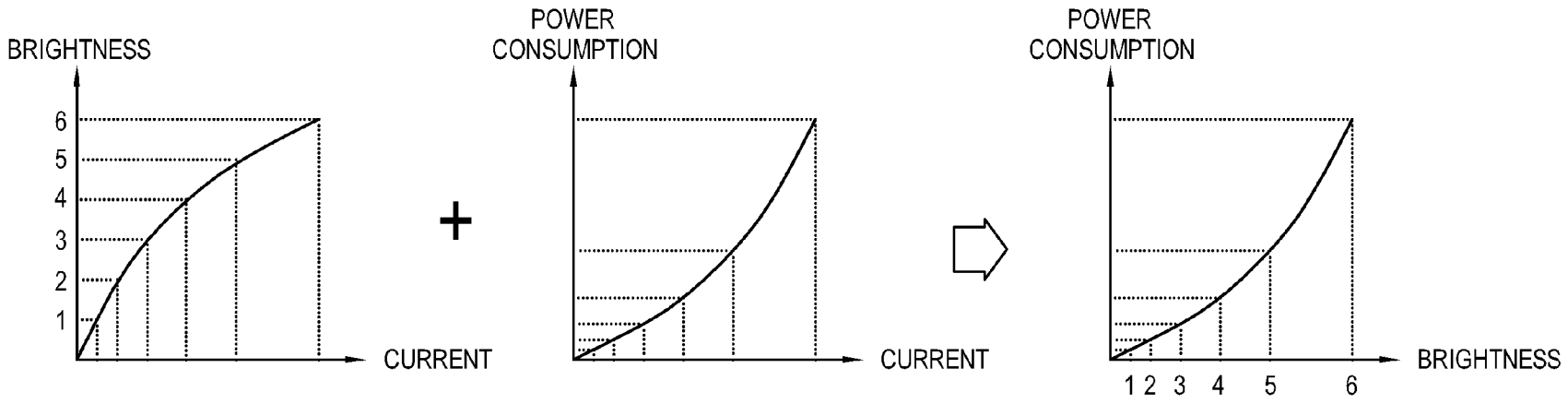
FIG. 3 shows electrical and optical characteristics of a related art analog dimming method.
Figure 4:
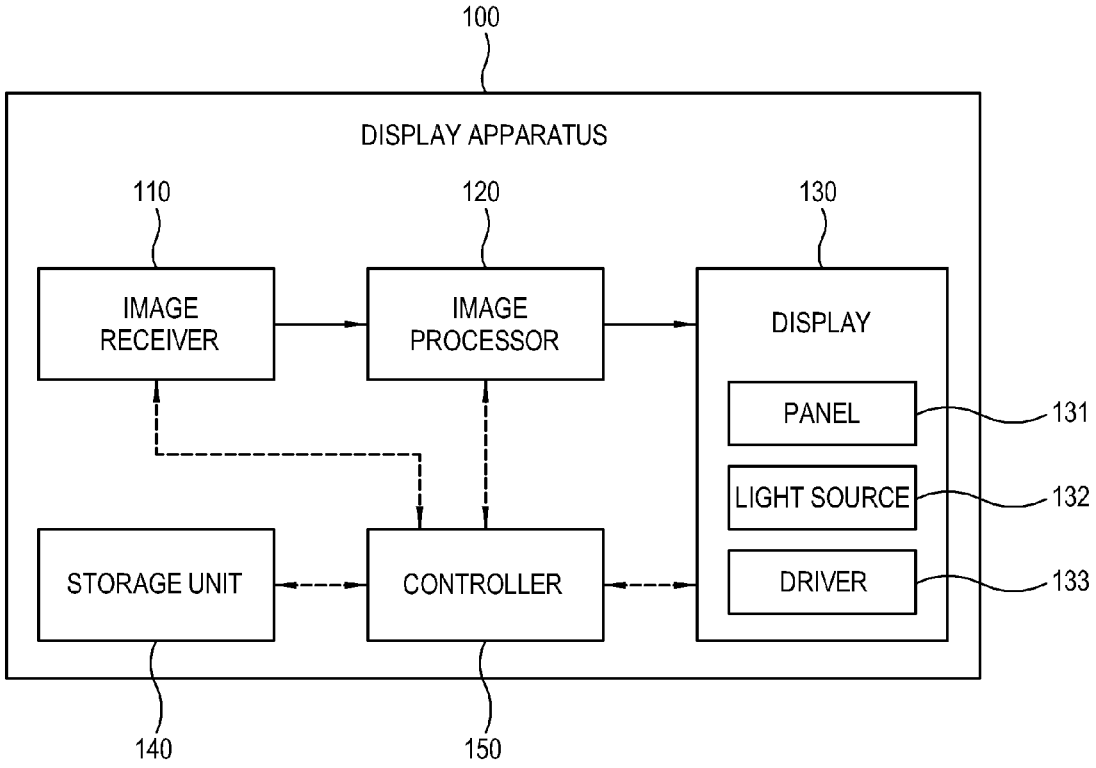
FIG. 4 is a block diagram of a display apparatus according to an exemplary embodiment.

FIG. 4 is a block diagram of a display apparatus 100 according to an exemplary embodiment.

As shown in FIG. 4, the display apparatus 100 processes an image signal received from an external image source (not shown) through a preset imaging process, and displays it as an image.

In this exemplary embodiment, a TV which processes a broadcasting image based on a broadcasting signal/broadcasting information/broadcasting data will be described as the display apparatus. However, an exemplary embodiment is not limited thereto. Alternatively, the display apparatus 100 may for example include a monitor, etc., besides the TV as long as it can process an image.

Further, the kind of image to be displayable on the display apparatus 100 is not limited to the broadcasting image. For instance, the display apparatus 100 may display a moving image, a still image, an application, on-screen display (OSD), a graphic user interface or the like images for various operation controls, based on signals/data received from various image sources (not shown).

In this exemplary embodiment, the display apparatus 100 may be achieved by a smart TV. The smart TV may receive and display a broadcasting signal in real time, have a web-browser function that enables various-contents search and consumption through Internet while displaying the broadcasting signal in real time, and provide a convenient user environment. Also, the smart TV includes an open software platform which provides a user with an interactive service. Thus, the smart TV may provide a user with various contents, e.g., an application for a predetermined service through an open software platform. For example, such an application can provide various kinds of service and may include social network service (SNS), financial service, news, weather, a map, music, a movie, a game, an electronic book, etc.

As shown in FIG. 4, the display apparatus 100 includes an image receiver 110 to receive an image signal, an image processor 120 to process the image signal received in the image receiver 110, a display 130 to display the image signal processed by the image processor 120 as an image, a storage unit 140 to store various data/information, and a controller 150 to control operations of the display apparatus 100.

The image receiver 110 receives an image signal and transmits it to the image processor 120. The image receiver 110 may be achieved in various forms, in accordance with formats of the received image signal and types of the display apparatus 100. For example, the image receiver 110 may receive a radio frequency (RF) signal from a broadcasting station (not shown) wirelessly, or may receive an image signal based on composite video, component video, super video, SCART, high definition multimedia interface (HDMI), etc., through a wire. The image receiver 110 includes a tuner to be tuned to a channel for receiving a broadcasting signal if the image signal is the broadcasting signal.

Further, the image signal may be received from an external device such as a personal computer (PC), an audio/video (AV) device, a smart phone, a smart pad, etc. Also, the image signal may be based on data received through Internet or a similar network. In this case, the display apparatus 100 may further include a communicator (not shown) to perform communication through the network. Also, the image signal may be based on data stored in a flash memory, a hard disk drive, or a similar nonvolatile storage unit 140. The storage unit 140 may be provided inside or outside the display apparatus 100. In the case that the storage unit 140 is provided outside the display apparatus 100, there may be an additional connector (not shown) to which the storage unit 140 is connected.

The image processor 120 performs various imaging processes previously set up with regard to the image signal. The image processor 120 outputs the processed image signal to the display 130, so that the display 130 can display an image.

The kind of imaging processes performed in the image processor 120 is not limited. For example, the imaging processes may include decoding corresponding to a variety of image formats, de-interlacing, frame refresh rate conversion, scaling, noise reduction for improving quality of an image, detail enhancement, line scanning, etc.

The image processor 120 may be achieved by an individual group for independently implementing each process, or a system-on-chip where various functions are integrated. For example, the image processor 120 may be achieved by an image board 101 (e.g., see image board 101 in FIG. 5) where various chipsets (not shown) for performing such processes, a memory (not shown), electronic parts (not shown), wiring (not shown) or similar circuit elements are mounted on a printed circuit board (not shown). In the display apparatus 100 according to an exemplary embodiment, the image receiver 110, the image processor 120 and the controller 150 may be provided in a single image board 101. Of course, this is an example. Alternatively, the image receiver 110, the image processor 120, and the controller 150 may be respectively provided in a plurality of printed circuit boards connected to perform communication with each other. Further, the image board 101 may be accommodated in a casing.

The display 130 displays an image based on the image signal processed by the image processor 120. There is no limit to the type of the display 130. As a flat panel display (FPD), the display 130 may be for example achieved by liquid crystal, plasma, a light emitting diode (LED), an organic light-emitting diode (OLED), a surface-conduction electron-emitter, a carbon nano-tube, nano-crystal, or similar various display types.

The display 130 may include an additional element in accordance with its types. In particular, the display 130 as shown in FIG. 4 includes a panel 131 for displaying an image, and a driver 132 for driving the panel 131. If the display 130 is achieved by the liquid crystal or the LED, a light source 132 (hereinafter, "backlight unit") may be further provided to emit light to the panel 131.

The light source 132 may be classified into an edge type where it is arranged in at least one edge of the panel 131 of the display 130, and a direct type where it is arranged behind the panel 131. As an example of a light source driving apparatus according to an exemplary embodiment, a driver 133 may be achieved in the form of an independent printed circuit board (PCB) provided with at least one circuit device. Alternatively, the light source 131 and the driver 133 may be provided as a single device. The driver 133 controls a current supplied to the light source 132 so that the desired quantity of light can be emitted from the light source 132.

According to an exemplary embodiment shown in FIG. 4, the display 130, achieved by the LED type, includes the panel 131, the light source 132 with an LED backlight, and the driver 133 with an LED driver. However, the exemplary embodiment is not limited thereto. For example, this exemplary embodiment may be applied to a case of the light source 132 with an LCD backlight or the panel 131 with an OLED cell. If the panel 131 is achieved by the OLED type, the driver 133 may control the current supplied to each light emission cell so that the desired quantity of light can be emitted from the light emission cell in the panel 131.

In this exemplary embodiment, the display 130 performs dimming for controlling the quantity of light from the light source, and displays an image on the panel 131.

Under control of the controller 150, the storage unit 140 stores data without any restriction. The data stored in the storage unit 140 may for example include not only an operating system for operating the display apparatus 100, but also various applications executable on this operating system, image data, additional data, etc. In this exemplary embodiment, the storage unit 140 may further store information for selecting a reference current corresponding to a plurality of screen modes.

The storage unit 140 is accessed by the controller 150, so that reading/recording/modifying/deleting/update/etc., of the controller 150 can be performed therein with regard to the data. The storage unit 140 is achieved by a nonvolatile storage medium such as a flash-memory and a hard-disk drive.

The controller 150 performs control for various elements of the display apparatus 100. For example, the controller 150 proceeds with the imaging process of the image processor 120 and performs a control operation corresponding to a command from a remote controller, thereby controlling operations of the display apparatus 100. For example, the controller 150 may be achieved in the form of combination between a central processing unit (CPU) and firmware/software.

In this exemplary embodiment, the display apparatus 100 is controlled by the controller 150 to set up a plurality of current levels corresponding to a plurality of screen modes (hereinafter, referred to as a 'mode') of the display 130, and to receive a current having a level corresponding to the present screen mode of the display 130. Therefore, the controller 150 controls the display apparatus 100 to perform the dimming for adjusting the quantity of light. In this exemplary embodiment, the plurality of screen modes includes a standard mode, a dynamic mode, and a eco mode by way of example. The present exemplary embodiment may be applied to all cases having at least two screen modes.

Figure 5:
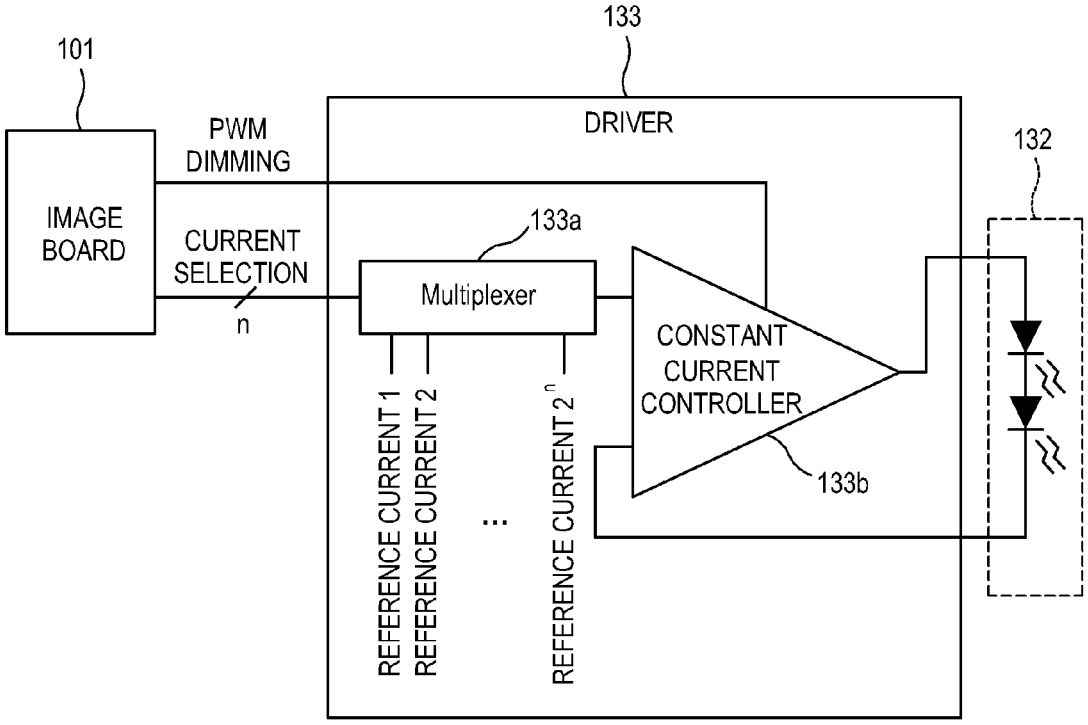
FIG. 5 shows operations of a dimming method according to an exemplary embodiment.

FIG. 5 shows operations of a dimming method according to an exemplary embodiment.

As shown in FIG. 5, the controller 150 provided in the image board 101 selects a current corresponding to the screen mode of the display 130, and controls the driver 133 to supply the selected current to the light source 132. The current level corresponding to the screen mode is previously set up and stored in the storage unit 140.

Further, the controller 150 performs the dimming per frame of an image displayed on the panel 131 in the state that the current selected corresponding to the screen mode is being supplied. The dimming is the PWM dimming where duty is changed.

In the case of the analog dimming where the level of the current supplied to the light source 132 is changed, it is difficult to change the level of the current in real time per frame while an image is displayed, because the response of the current output to the light source 132 is slow. However, according to an exemplary embodiment, even though the response to the change in the current level corresponding to the change in the screen mode is somewhat slow, a delay due to the slow response is acceptable to the extent that a user is not inconvenienced.

Thus, this exemplary embodiment employs both advantages of the analog dimming and the PWM dimming, thereby improving the light-emitting efficiency of the LED or similar light source, and lowering the power consumption of a product under the screen mode of supplying a low current.

As shown in FIG. 4, the controller 150 outputs a current selection signal as a control signal for selecting the reference current to drive the light source 132 in accordance with the screen modes.

As shown in FIG. 5, the driver 133 includes a multiplexer 133*a* for selecting one reference current, among the plurality of reference currents REFERENCE CURRENT1, REFERENCE CURRENT2, . . . , REFERENCE CURRENT 2n, corresponding to the plurality of modes in response to the current selection signal received from the controller 150. Further, the driver 133 includes a constant current controller 133*b* for supplying the reference current output from the multiplexer 133*a* to the light source 132 and controlling the reference current to be constant. If the number of current selection signals or the number of signal lines is n, the number of reference currents selectable by the multiplexer 133*a* is 2n.

Figure 6:
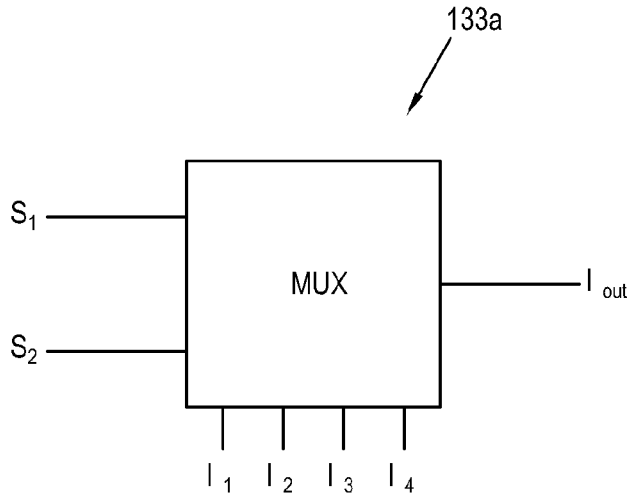
FIGS. 6 to 8 show a multiplexer of FIG. 5.
Figure 7:
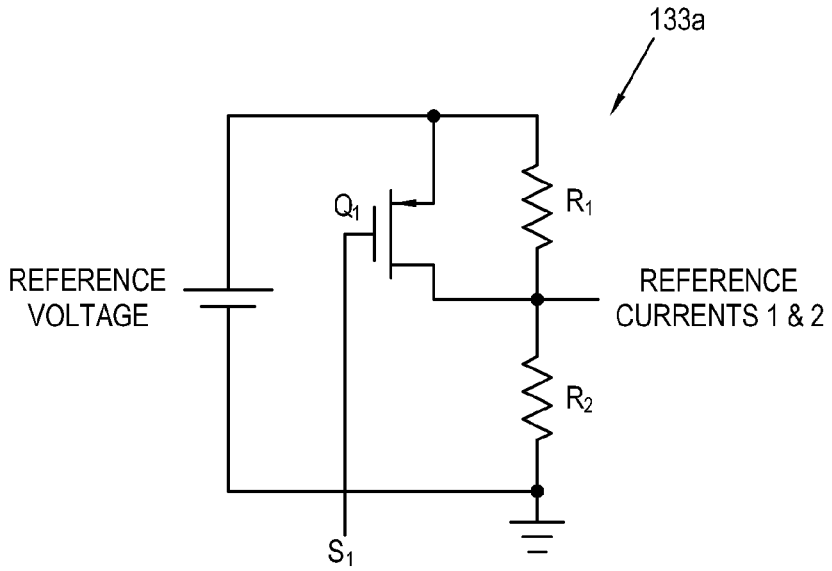
Figure 8:
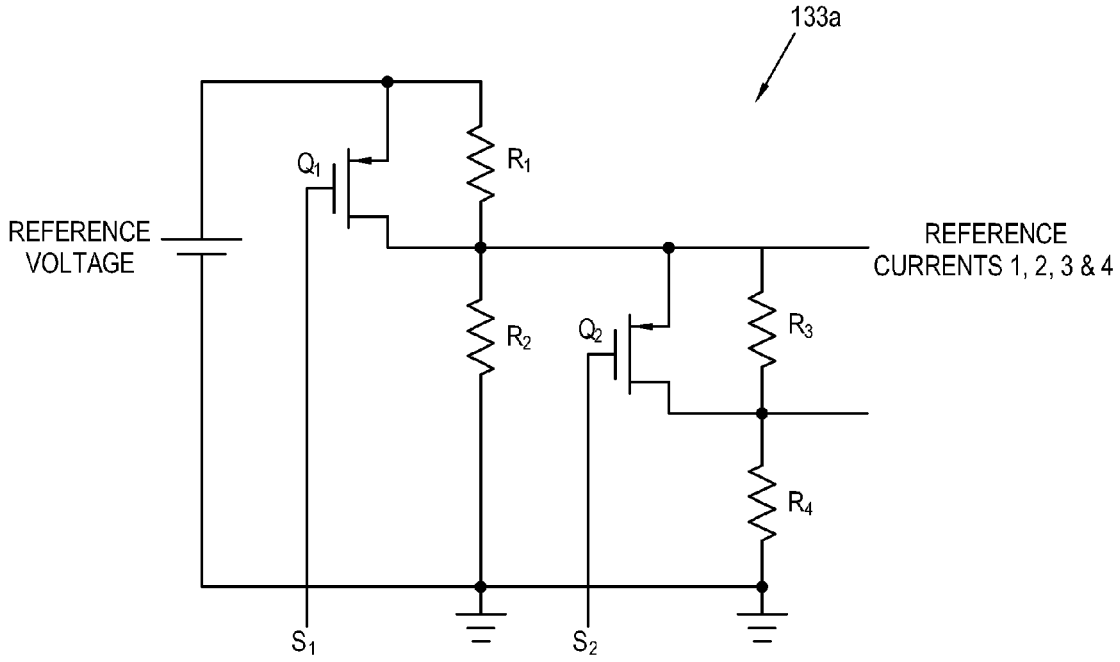

FIGS. 6 to 8 show examples of the multiplexer 133*a* of FIG. 5.

The multiplexer 133*a* may be achieved by a single multiplexer integrated chip (IC) as shown in FIG. 6, or may be achieved by current setup circuits provided as separate parts as shown in FIGS. 7 and 8.

As shown in FIG. 6, if there are four screen modes, the multiplexer 133*a* selects and outputs one reference current, among the plurality of reference currents I1, I2, I3, I4, in response to the current selection signals S1, S2 from the controller 150, in which the plurality of reference currents I1, I2, I3, I4 is previously set up to have the levels corresponding to the plurality of screen modes. For example, it is possible to set up as follows: I1=1 A, I2=0.8 A, I3=0.6 A, and I4=0.3 A. In this case, I1 corresponds to the brightest mode, and I4 corresponds to the darkest mode. FIG. 6 illustrates a case that four reference currents I1, I2, I3, I4 are selectively output in response to two current selection signals S1, S2. However, exemplary embodiments are not limited thereto. Alternatively, it may be varied depending on the number of screen modes.

As shown in FIG. 7, if there are two screen modes and the multiplexer 133*a* is the current setup circuit, the current setup circuit includes a switch Q1 turned on/off in response to a gate signal, i.e., the current selection signal S1, and resistors R1 and R2 for distributing and outputting the current in accordance with the on/off of the switch Q1. The switch Q1 may be achieved by a metal oxide semiconductor field effect transistor (MOSFET) of a P-MOS type. In the current setup circuit of FIG. 7, the switch Q1 is turned on/off in accordance with the current selection signal S1, so that one of two reference currents 1 and 2 respectively corresponding to the on/off can be selectively output.

FIG. 8 shows an exemplary case that the current setup circuit has four screen modes. In comparison with the circuit of FIG. 7, the current setup circuit of FIG. 8 further includes a switch Q2 turned on/off in response to the current selection signal S2, and resistors R3 and R4 for distributing and outputting the current in accordance with the on/off of the switch Q2. Similarly, in the current setup circuit of FIG. 8, the switches Q1 and Q2 are respectively turned on/off in accordance with the current selection signals S1 and S2, so that one of four reference currents 1, 2, 3 and 4 corresponding to the combination of on/off of the respective switches Q1 and Q2 can be selectively output.

Figure 9:
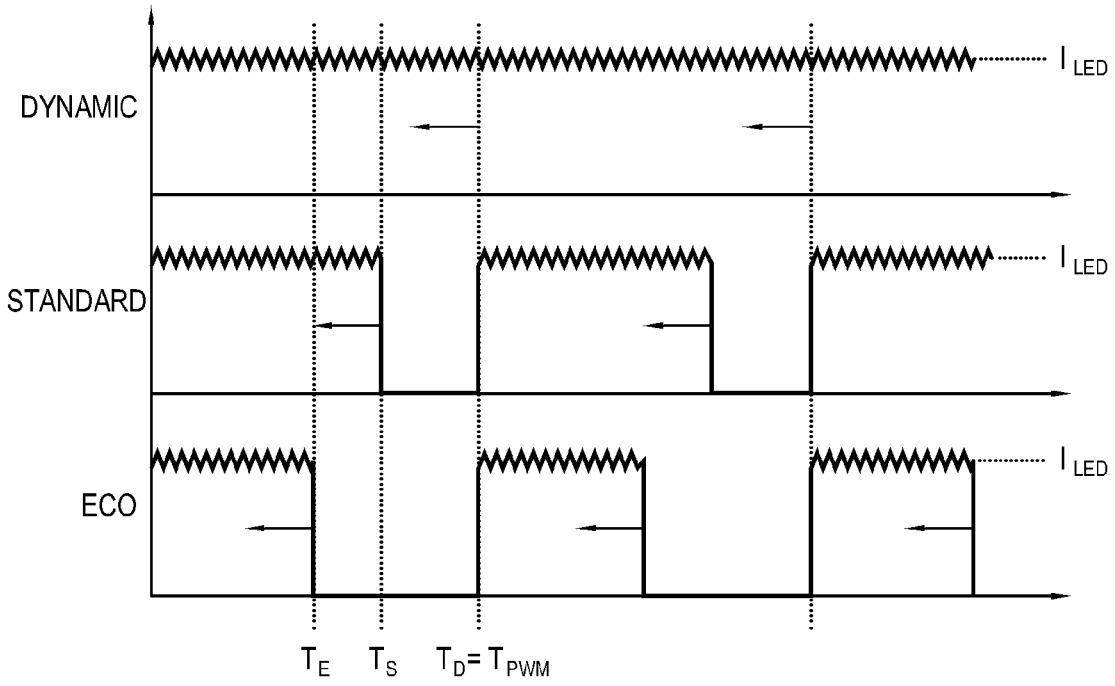
FIG. 9 shows waveforms of a driving current supplied to a light source in a related art display apparatus.
Figure 10:
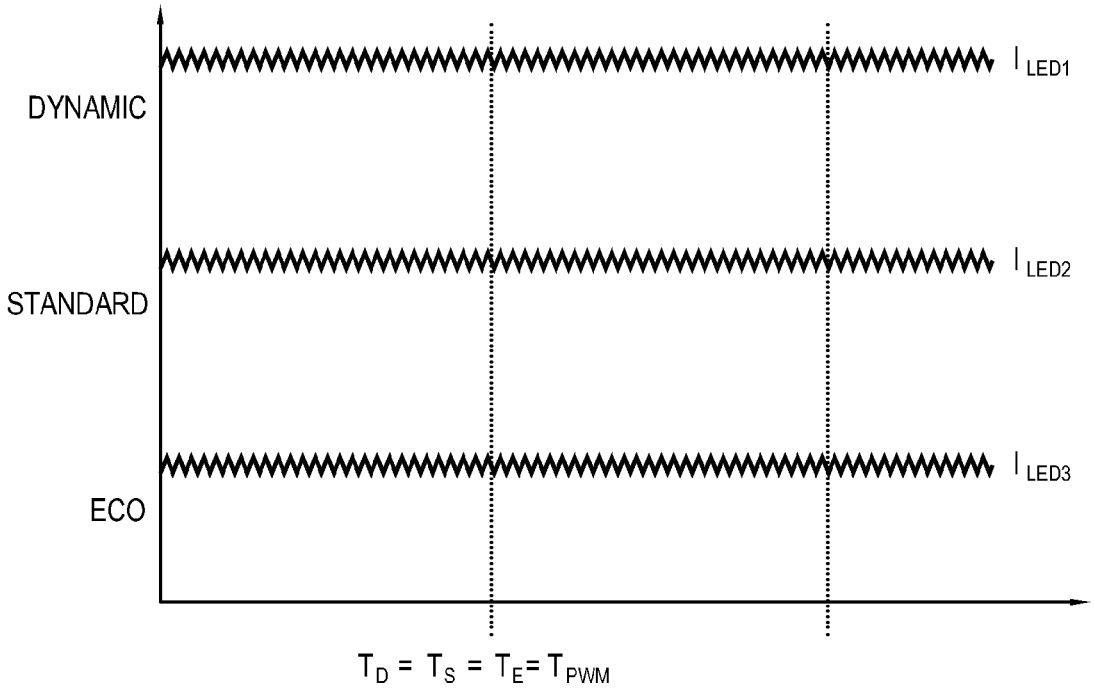
FIG. 10 shows waveforms of a driving current supplied to a light source in a display apparatus according to an exemplary embodiment.

FIG. 9 shows waveforms of a driving current supplied to a light source in a related art display apparatus, and FIG. 10 shows waveforms of a driving current supplied to a light source in a display apparatus according to an exemplary embodiment.

As shown in FIG. 9, a related art display apparatus 10 supplies the same driving current ILED to the light source 13, e.g., a LED backlight regardless of the screen mode, i.e., in the standard mode, the dynamic mode, and the eco mode.

On the other hand, as shown in FIG. 10, the display apparatus 100 according to an exemplary embodiment supplies different driving currents ILED1, ILED2, ILED3 in a level to the light source 132, e.g., the LED backlight in accordance with the screen modes. In particular, as shown in FIG. 10, if the display 130 has three screen modes of the standard mode, the dynamic mode, and the eco mode, the highest current ILED1 is supplied to the LED backlight in the dynamic mode, and the lowest current ILED3 is supplied to the LED backlight in the eco mode.

In the display apparatus 100 according to this exemplary embodiment, by a simple method of adding the current setup circuit provided with a few parts or the multiplexer IC to the driver 133, it is possible to control the driver 133 to supply a current having a level corresponding to the screen mode of the display 130 to the light source 132. Therefore, without any separate circuit needed for the related art analog dimming, such as a D/A converter for generating an analog signal, it is possible to expect the analog dimming effect to improve a light-emission efficiency and lower power consumption.

As shown in FIG. 5, the controller 150 controls the driver 133 to supply the light source 132 with the current having a level corresponding to the screen mode of the display 130, and at the same time perform the PWM dimming where the duty of the current supplied to the light source 132, i.e., the LED backlight is changed. The PWM dimming may be for example performed to control the backlight to become dark in a dark screen and bright in a bright screen.

Figure 11:
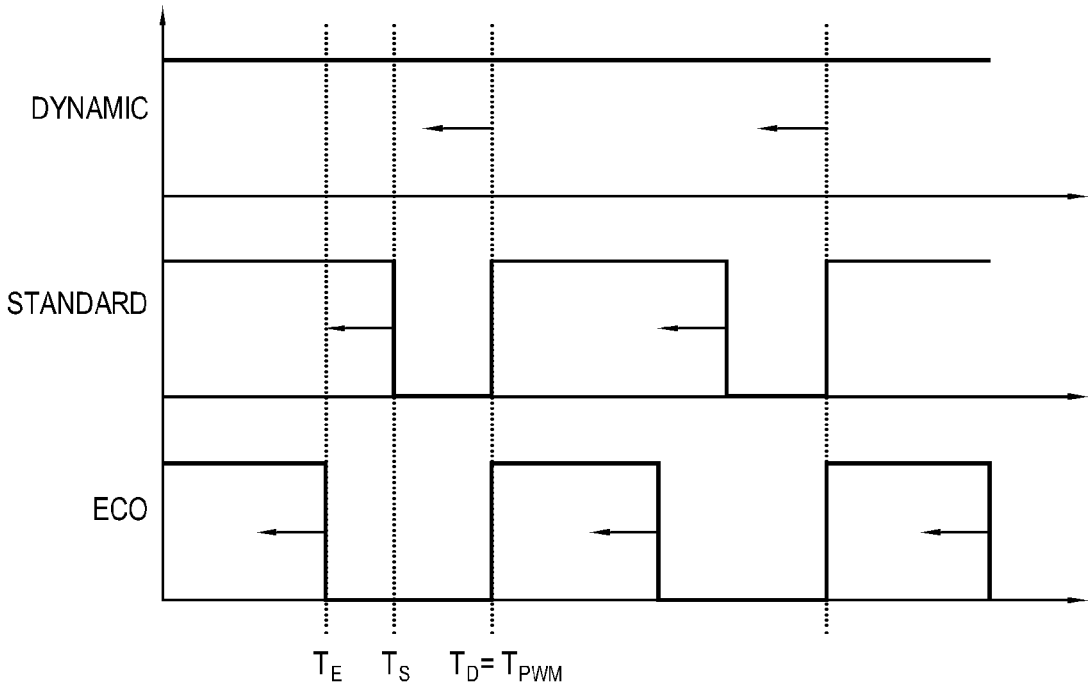
FIG. 11 shows waveforms of a dimming signal for performing PWM dimming in the related art display apparatus.
Figure 12:
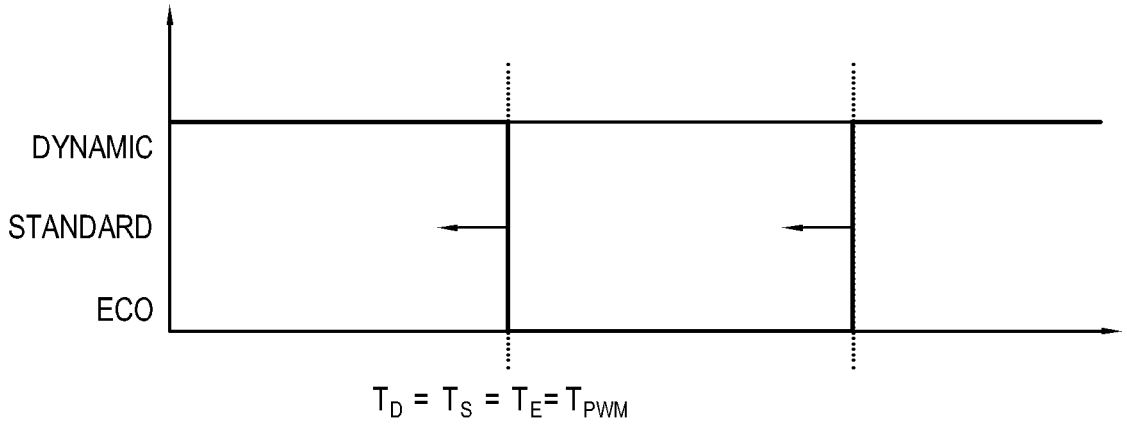
FIG. 12 shows waveforms of a dimming signal for performing the PWM dimming in the display apparatus according to an exemplary embodiment.

FIG. 11 shows waveforms of a dimming signal for performing PWM dimming in the related art display apparatus, and FIG. 12 shows waveforms of a dimming signal for performing the PWM dimming in the display apparatus according to an exemplary embodiment.

As shown in FIG. 11, the related art display apparatus 10 shows that the maximum duties TD, TS, TE of the PWM dimming are differently controlled in accordance with the screen modes. In particular, as shown in FIG. 11, if the display 130 has three screen modes of the standard mode, the dynamic mode and the eco mode, the maximum duty TD of the dynamic mode is the largest and the maximum duty TE of the eco mode is the smallest. The maximum duty TD of the dynamic mode may be set up by 100% with regard to the maximum duty TPWM of the display apparatus 10, the maximum duty TS of the standard mode may be set up by 70%, and the maximum duty TE of the eco mode may be set up by 50%.

In contrast, as shown in FIG. 12, the display apparatus 100 according to this exemplary embodiment shows that the duties of all modes are changeable up to 100%, regardless of the screen mode. For example, the maximum duties of the standard, dynamic, and eco modes may be equivalently controlled as TS=TD=IE=TPWM. Therefore, as compared with the related art display apparatus where the maximum duty is limited by the screen mode, the dimming can be minutely (i.e., specifically) controlled to correspond with the brightness of an image per frame processed by the image processor 120.

In the embodiment shown in FIG. 12, the duty is changed up to 100% regardless of the screen modes. However, the embodiment is not limited thereto. Alternatively, the maximum duty may be limited in accordance with the screen modes. For example, in the eco mode for reducing the power consumption, the maximum duty may be limited to 50%, thereby heightening an effect on reducing power consumption.

A driving method of the display apparatus 100 according to an exemplary embodiment will be described with reference to the accompanying drawings.

Figure 13:
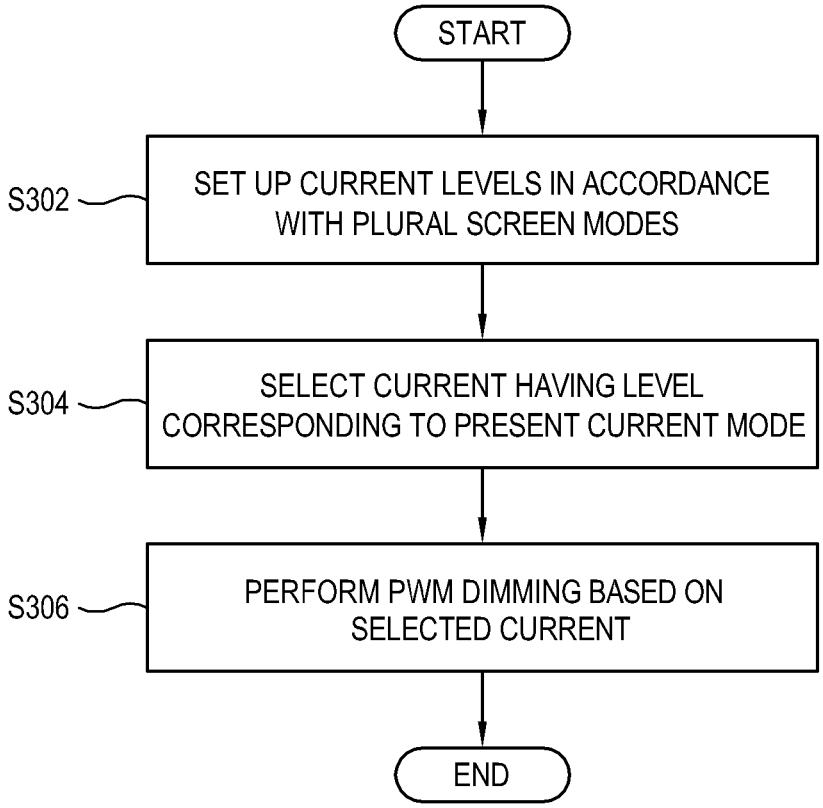
FIG. 13 is a flowchart showing a driving method of a display apparatus according to an exemplary embodiment.

FIG. 13 is a flowchart showing a driving method of a display apparatus 100 according to an exemplary embodiment.

As shown in FIG. 13, the display apparatus 100 sets up the plurality of current levels corresponding to the plurality of screen modes for the display 130 (S302). The plurality of screen modes includes at least two screen modes among the standard mode, the dynamic mode, and the eco mode. Further, the plurality of reference currents output from the multiplexer 133*a*, as shown in FIGS. 5 to 8, to the driver 133 for driving the light source 132 may be set up as the current levels corresponding to the screen modes, respectively.

The controller 150 selects the current having the level corresponding to the present screen mode, among the currents having the levels set up in the operation S302 (S304). The controller 150 outputs a predetermined current selection signal to the multiplexer 133*a*, and the multiplexer 133*a* selects the reference current corresponding to the received current selection signal. The selected reference current is supplied as the driving current for the light source 132 to the light source 132, e.g., the LED backlight unit.

The controller 150 controls the display 130 so that the PWM dimming can be performed by the current selected in the operation S304, and supplied to the light source 132 (S306). The PWM dimming is performed to control the brightness of the light source 132, e.g., the LED backlight per frame in accordance with the brightness of an image displayed on the panel 131. Therefore, the backlight is controlled to become dark in a dark screen and bright in a bright screen.

According to an exemplary embodiment, the current supplied to the backlight is changed to a level according to the screen modes. Thus, it is possible to expect the analog dimming effect in which the light-emission efficiency of the light source, such as the LED, is improved in the screen mode of supplying a current having a low level and the power consumption is reduced.

The PWM dimming is performed to change the duty up to 100%, in accordance with the brightness of an image displayed on the display regardless of the screen mode. Therefore, the dimming can be more quickly and minutely controlled per frame of an image.

Therefore, this exemplary embodiment employs both advantages of the analog dimming and the PWM dimming. Therefore, stability and reliability is improved in the operation of the display apparatus.

Although a few exemplary embodiments have been shown and described, it will be appreciated by those skilled in the art that changes may be made in these exemplary embodiments without departing from the principles and spirit of the invention. Therefore, the foregoing has to be considered as illustrative only. The scope of the invention is defined in the appended claims and their equivalents. Accordingly, all suitable modification and equivalents may fall within the scope of the invention.

What is claimed is:

1. A display apparatus comprising:

an image processor which is configured to process an image comprising a plurality of frames; and a driver which is configured to drive a light source, the driver comprising a multiplexer and a constant current controller;

a controller which is configured:

to set a plurality of current levels corresponding to a plurality of screen modes for a display, in response to a screen mode among the plurality of screen modes, to control the multiplexes to select a reference current having a current level corresponding to the screen mode and to output the selected reference current to the constant current controller, and to control the constant current controller to supply the light source with a driving current having the current level corresponding to the screen mode based on the selected reference current output from the multiplexer by changing an on/off ratio of the current level to perform a dimming for each of the plurality of frames.

2. The display apparatus according to claim 1, wherein the display comprises:

a panel configured to display an image;

the light source configured to provide light to the panel; and the driver configured to drive the light source.

3. The display apparatus according to claim 2, wherein the controller is further configured to output a current selection signal to the driver corresponding to the screen mode of the display.

4. The display apparatus according to claim 3, wherein the multiplexer is configured to select and output one reference current among a plurality of reference currents in response to the current selection signal.

5. The display apparatus according to claim 4, wherein the multiplexer further comprises a current setup circuit which comprises at least one switch configured to turn on or off in response to receiving the current selection signal, and output the one reference current among the plurality of reference currents as the switch is turned on or off.

6. The display apparatus according to claim 1, wherein the display is configured to perform a pulse width modulation (PWM) dimming to change duty.

7. The display apparatus according to claim 6, wherein the duty of the PWM dimming is changed up to 100%.

8. The display apparatus according to claim 6, wherein a maximum duty of the PWM dimming is set in accordance with the plurality of screen modes.

9. The display apparatus according to claim 1, wherein the plurality of screen modes comprises at least two screen modes among a standard mode, a dynamic mode, and an eco mode.

10. The display apparatus according to claim 1, further comprising:

a display which is configured to display the image based on an image signal, wherein the image is displayed based on a quantity of light controlled by the dimming.

11. A method of driving a display apparatus which displays an image comprising a plurality of frames and includes a driver configured to drive a light source and comprising a multiplexer and a constant current controller, the method comprising:

setting a plurality of current levels corresponding to a plurality of screen modes for a display;

in response to a screen mode among the plurality of screen modes, selecting, by the multiplexer, a reference current having a current level corresponding to the screen mode and outputting, by the multiplexer, the selected reference current to the constant controller, and supplying, by the constant current controller, the light source with a driving current having the current level corresponding to the screen mode based on the selected reference current output from the multiplexer by changing an on/off ratio of the current level to perform a dimming for each of the plurality of frames.

12. The method according to claim 11, wherein the display comprises:

a panel configured to display an image;

the light source configured to provide light to the panel; and the driver configured to drive the light source.

13. The method according to claim 12, further comprising outputting a current selection signal to the driver corresponding to the screen mode of the display.

14. The method according to claim 13, further comprising selecting and outputting one reference current among a plurality of reference currents in response to the current selection signal.

15. The method according to claim 11, wherein the performing the dimming comprises performing a pulse width modulation (PWM) dimming to change duty.

16. The method according to claim 15, wherein the duty of the PWM dimming is changed up to 100%.

17. The method according to claim 15, wherein a maximum duty of the PWM dimming is set in accordance with the plurality of screen modes.

18. The method according to claim 11, wherein the plurality of screen modes comprises at least two screen modes among a standard mode, a dynamic mode, and an eco mode.

19. A light source driving apparatus for a display apparatus, comprising:

a multiplexer; and a constant current controller, wherein the multiplexer is configured, in response to a screen mode among a plurality of screen modes, to select a reference current having a current level corresponding to the screen mode and to output the selected reference current to the constant current controller, and the constant current controller is configured to supply a light source with a driving current having the current level corresponding to the screen mode based on the selected reference current output from the multiplexer by changing an on/off ratio of the current level to perform a dimming for each of a plurality of frames of an image.

20. The light source driving apparatus according to claim 19, wherein the light source driving apparatus performs a pulse width modulation (PWM) dimming to change duty of the one reference current supplied to the light source.

21. The light source driving apparatus according to claim 20, wherein the duty of the PWM dimming is varied up to 100%.

22. The light source driving apparatus according to claim 20, wherein a maximum duty of the PWM dimming is set in accordance with the plurality of screen modes.

23. The light source driving apparatus according to claim 19, wherein the multiplexer comprises a current setup circuit which comprises at least one switch configured to turn on or off in response to receiving the current selection signal, and output the one reference current among the plurality of reference currents as the switch is turned on or off.

24. The light source driving apparatus according to claim 19, wherein the plurality of screen modes comprises at least two screen modes among a standard mode, a dynamic mode, and an eco mode.

25. The light source driving apparatus according to claim 19, wherein the light source comprises at least one light emitting diode (LED).

26. A method of driving a light source driving apparatus for a display apparatus including a driver which is configured to drive a light source and comprises a multiplexer and a constant current controller, the method comprising:

in response to a screen mode among a plurality of screen modes, selecting, by the multiplexer, a reference current having a current level corresponding to the screen mode and outputting, by the multiplexer, the selected reference current to the constant current controller, and supplying, by the constant current controller, the light source with a driving current having the current level corresponding to the screen mode based on the selected reference current output from the multiplexer by changing an on/off ratio of the current level to perform a dimming for each of a plurality of frames of an image.

27. The method of claim 26, further comprising:

performing a pulse width modulation (PWM) dimming to change duty of the one reference current supplied to the light source.

28. The method of claim 26, wherein the plurality of screen modes comprises at least two screen modes among a standard mode, a dynamic mode, and an eco mode.

* * * * *